US005316406A

United States Patent [19]

Wyckoff

[11] Patent Number: 5,316,406

[45] Date of Patent: * May 31, 1994

[54] SURFACE MARKER STRIP AND METHODS FOR PROVIDING IMPROVED INTEGRITY AND ADHESION TO ROADWAY AND THE LIKE

[75] Inventor: Charles W. Wyckoff, Needham, Mass.

[73] Assignee: Briteline Industries, Inc., Lexington, Mass.

[ * ] Notice: The portion of the term of this patent subsequent to Feb. 11, 2009 has been disclaimed.

[21] Appl. No.: 930,785

[22] Filed: Aug. 17, 1992

Related U.S. Application Data

[60] Division of Ser. No. 630,081, Dec. 19, 1990, Pat. No. 5,139,590, which is a division of Ser. No. 611,135, Nov. 13, 1990, Pat. No. 5,087,148, which is a continuation of Ser. No. 309,312, Feb. 10, 1989, abandoned.

[51] Int. Cl.[5] ..... E01F 9/06; E01F 9/08

[52] U.S. Cl. ..... 404/12; 404/14

[58] Field of Search ..... 404/12, 14; 156/278, 156/280, 307.3; 428/212, 167, 168, 149

[56] References Cited

U.S. PATENT DOCUMENTS

| | | | |
|---|---|---|---|
| 3,399,607 | 9/1968 | Eigenmann | 74/1.5 |
| 3,587,415 | 6/1971 | Eigenmann | 94/1.5 |
| 3,920,346 | 11/1975 | Wyckoff | 404/14 |
| 4,040,760 | 8/1977 | Wyckoff | 404/14 |
| 4,069,787 | 1/1978 | Wyckoff | 116/63 R |
| 4,117,192 | 9/1978 | Jorgensen | 428/337 |
| 4,236,788 | 12/1980 | Wyckoff | 350/97 |
| 4,388,359 | 6/1983 | Ethen et al. | 428/143 |
| 4,490,432 | 12/1984 | Jordan | 428/220 |
| 4,656,077 | 4/1987 | Larimore et al. | 428/212 |
| 4,681,401 | 7/1987 | Wyckoff | 350/105 |
| 5,087,148 | 2/1992 | Wyckoff | 404/12 |

*Primary Examiner*—William P. Neuder

*Attorney, Agent, or Firm*—Rines & Rines

[57] ABSTRACT

An improved roadway marker rubber-like strip in which the upper layer is deformed into protruberances such as wedges or ridges, preferably provided with a coating of exposed retro-reflective beads, that have been cross-link-vulcanized to provide the same with memory that permits shape restoration following depression by vehicle traffic, and a cold-flow un-vulcanized bottom layer adhered to the roadway and conforming without memory to the same under vehicle traffic.

3 Claims, 1 Drawing Sheet

SURFACE MARKER STRIP AND METHODS FOR PROVIDING IMPROVED INTEGRITY AND ADHESION TO ROADWAY AND THE LIKE

This is a division of application Ser. No. 630,081 filed Dec. 19, 1990; which is a division of application Ser. No. 611,315 filed Nov. 13, 1990 (now U.S. Pat. No. 5,087,148); which is a continuation of application Ser. No. 309,213 filed Feb. 10, 1989 (now abandoned).

BACKGROUND OF THE INVENTION

The present invention relates to surface marker strips as for roadways, pavements and other surfaces, being more particularly directed to method of providing better roadway-adhering and longer-life properties to such market strips, and to marker strips of tapes with preformed ridges adhered to the roadways and the like of vastly improved integrity and life that, by reflection and/or retroreflection from the ridges, enable enhanced visibility, especially upon illumination by the headlights of approaching vehicles.

A paramount problem with preformed plastic pavement marker strips of the prior art is that of providing satisfactory adherence to the road surface under the constant heavy pounding of motor vehicle traffic. Unless the pavement marker has a deformable layer of elastomeric material which lacks memory positioned between the marker and the road surface, good adhesion will not always be achieved. This layer must deform readily and flow without memory into the irregular surface contours of the pavement. The deformability and ability to cold flow permits the absorption of the energy of vehicle tire impacts which would otherwise violently dislodge the pavement marker as the impact energy is dissipated. With an elastic material, adhesion to the road surface is weakened with the road is wet because the stretch-return action of such a memory material causes a pumping action to occur in which water-bearing dirt is forced between the material and the road surface. Dirt then becomes deposited between the adhesive material and the road surface and ultimately destroys the adhesive properties holding the pavement marker to the road.

While for some applications, techniques for adhesion of the type employed with marker strips of my earlier U.S. Pat. Nos. 3,920,346; 4,040,760; 4,069,787; 4,236,788 and 4,681,401 involving a thick mastic, provided a measure of the deformability and cold flow characteristics discussed above, for extensive use and under severe traffic and temperature varying circumstances, however, this technique proved at best to be only a compromise. Additionally, the mastic adhesive proved difficult to apply to the product in an economical manner. During extensive heat of summer, the adhesive had a tendency to flow readily as it became warm, with the result that the pavement-marker would creep or move with very heavy traffic. Sometimes the extremely low temperature of winter, moreover, would reduce the bonding force between the adhesive and the pavement marker with the disastrous result of removal by snowplow action.

This problem of adequately securing a preformed plastic pavement-marker tape to the road surface was also recognized and partially solved in prior art U.S. Pat. Nos. 3,399,607; 3,587,415 and 4,117,192 and other. The techniques proposed in these patents involved base materials which exhibit desirable characteristics of deformability and lack of memory or cold flow which will provide conformability to the road surface and will absorb the shock energy of vehicular traffic. While useful for preformed flat surface pavement-marker tapes, however, such techniques do not adequately solve the problem for strips or tapes having preformed ridges such as those disclosed in my said earlier patents cited above. Because such prior art material has no memory and exhibits cold flow characteristics, any protuberance such as a ridge or wedge on the surface very quickly disappears when impacted by vehicular traffic so that the ridges flatten out and lose shape under the pressure of the vehicle tires. This, of course, defeats the primary purpose of high visibility of the protuberances or ridges as low viewing angles. If the ridges were comprised of a harder or more rigid material such as, for example, polyvinyl chloride or epoxy or some other rigid or semi-rigid material, they would soon be engulfed by the non-memory cold flow characteristic of the base material under the pressure of the traversing traffic. Once depressed into the base material, the ridges would no longer protrude above a film of rain water and would thus be useless as high visibility ridges for wet night visibility.

As disclosed in U.S. Pat. No. 4,490,432 which incorporates the teachings of U.S. Pat. No. 4,388,359, an attempt was made to solve this problem by including reinforcing fibers with the mix of the non-memory cold-flowing elasomteric base material. It was hoped that the fiber would offer sufficient stiffness to overcome the problem of losing the protuberances upon impact of high volume vehicular traffic. This, however, has not proven to be a completely successful solution; and in a short time, the protuberances become, in practice, flattened into the base material where they lose their function and utility.

BRIEF DESCRIPTION OF THE INVENTION

Underlying the present invention, on the other hand, is the discovery that a combined-layered non-vulcanized and vulcanizable rubber sheeting can admirably provide a superior solution to the above-mentioned problems. The conformability and shock energy absorbing features of a non-vulcanized elastomeric rubber sheeting when combined with a vulcanizable elastomeric rubber serving as the top portion of the tape or strip and in which the protuberances or ridges are formed enables the attainment of the novel results herein. After vulcanizing the top layer containing the ridges, the ridges can be stretched or flattened or otherwise depressed or deformed by vehicular traffic, but, because of their memory characteristics, will be restored to their original shape after cessation of said traffic. While the elastic property of the vulcanized top portion comprising the ridge structure contains sufficient memory to permit such restoration of shape, such is not enough to inhibit deformability of the soft elastomeric bottom portion which conforms to the road surface and which, with its non-memory property, readily absorbs the shock energy of the wheel impacts of the vehicular traffic.

An object of the invention, accordingly, is to provide a new and improved marker strip or tape for roadways and the like that is not subject to the previously described short-comings of prior devices but that, through a layered combination of a non-vulcanized lower rubber-like surface that conformably adheres to the roadway and an upper vulcanized rubber-like surface containing the marker ridges provides long-lasting adhesion and integrity of the ridges during use.

Other and further objects will be explained hereinafter and are more particularly delineated in the appended claims.

In summary, however, from one of its important aspects, the invention embodies a roadway marker strip for adhesively attaching along its bottom surface to the roadway, comprising a rubber-like sheet the bottom layer and surface of which is of cold-flow characteristics and the upper layer and surface of which is deformed into successive protruberances such as ridges and wedges from which incident light from a vehicle traveling along the roadway may be reflected or retro-reflected to indicate the roadway direction, with the upper layer being cross-link-vulcanized to enable restoration of depression of the protruberances caused by vehicle wheels traveling thereover while the strip conformably adheres to the roadway. Preferred and best mode embodiment details are hereinafter presented.

BRIEF DESCRIPTION OF THE FIGURES OF THE DRAWINGS

The invention will now be described with reference to the accompanying drawings.

Referring to the drawings, the base material 1 of the marker strip or tape is shown as comprised of a non-vulcanized rubber mixture in sheet form which lacks memory and is easily deformed because it is soft and exhibits cold flow characteristics. It is comprised of a rubber polymer such as acrylonitrile-butadiene in a non-vulcanized state. In addition reinforcing fibers, a pigment, and other processing aids are also included. An example of a typical formulation is listed in Table I in which the reinforcing fiber is given as wood pulp-like cellulose fibers. Other types of fibers including thermoplastic reinforcing fibers may be used without seriously degrading the deformability characteristic of the sheeting. In accordance with the invention, the bottom portion or layer of this material is left in this un-vulcanized cold-flow non-memory condition, and is attached by adhesive 6 (FIGS. 5 and 6) along the bottom surface to the roadway R. The top portion of the rubber sheeting material comprising the marker strip, however, is to be vulcanized to provide it with memory characteristics. Toward this end, the top layer may be treated as by a shallow layer of peroxide material 1' which penetrates the rubber sheeting to a limited depth depicted by the speckled area of FIGS. 1 and 2. Because of the presence of peroxide of equivalent treatment, this region of the rubber sheeting can be readily cross-linked or vulcanized by the addition of heat. Prior to the heat, it has the same characteristics as the remainder of the sheet; i.e. it is soft, easily deformed and lacks memory. As illustrated in FIG. 2, the sheet of FIG. 1 has been embossed in the top surface with protruding wedges or ridges 3 and then heat is applied immediately thereafter in order to cross-link or vulcanize and harden this ridged top layer that had been permeated with peroxide, imparting to the ridges a permanent memory such that they can maintain shape with cold flow after vehicular depression, while the bottom of the sheeting 1 remains unvulcanized (not cross-linked) and thus deformable and memory-free to provide the necessary shock energy absorption of vehicular traffic and with conformability, to assist the adhesion in securing the marker to the road surface R. The protruding ridges or wedges 3 may be in the form of transversely extending parallel rows, successively longitudinally spaced along the strip, and may be segmented into ridge or wedge blocks, if desired, preferably with a trapezoidal cross-section providing inclined or near-vertical front and rear surfaces 1'' for reflecting incident low-angle headlight illumination as described in my aforesaid patents.

FIGS. 3 and 4 illustrate another method of accomplishing the same effect. In this case, the rubber sheeting base material consists of a two-ply laminate comprising a vulcanizable upper layer 2 laminated on top of a non-vulcanizable rubber sheeting layer 1. Layer 2 may contain the same ingredients as layer 1 in addition to vulcanizing agents, such as sulfur (Table II) or other compounds which react with the rubber to cross-link or vulcanize it to completion after the protuberances 3, FIG. 4, have been formed. Once vulcanized, the protuberances or ridges will maintain their shapes because the vulcanization process provides the material with a memory and a degree of surface hardness.

In FIG. 5, the top-embossed surface of FIG. 4 has a retro-reflecting bead-bonding layer 4 covering the entire surface. This layer may be any suitable bead bonding layer such as a vinyl acetate copolymer, a polyurethane, an epoxy or any material which will satisfactorily bond the glass retroreflective microspheres 5 to the structure, curing during the curing of the upper layer of the strip. The bead bonding layer 4 can be applied to the surface either prior to or after the ridges are embossed or otherwise formed. The coating of glass microspheres or beads 5 is applied to this layer 4 prior to solidification of the layer. After vulcanization of the top ridged layer, the beads become secured in a partially embedded manner therein with the beads partially exposed including especially on the inclined or near-vertical front and rear surfaces 1'' of the ridges or protuberances facing traffic.

Figure 1:
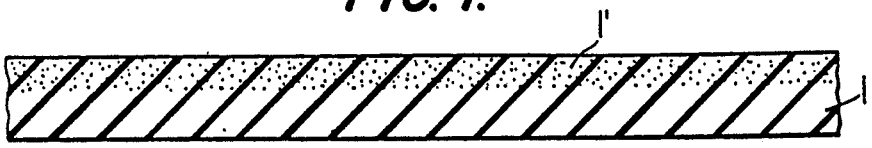
FIG. 1 of which is a cross-section through a single ply rubber sheeting prior to embossing the protuberances or ridges.
Figure 2:
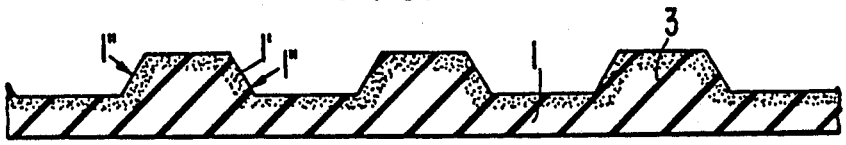
FIG. 2 is a cross-section through a single ply rubber sheeting after embossing the protruberances or ridges.
Figure 5:
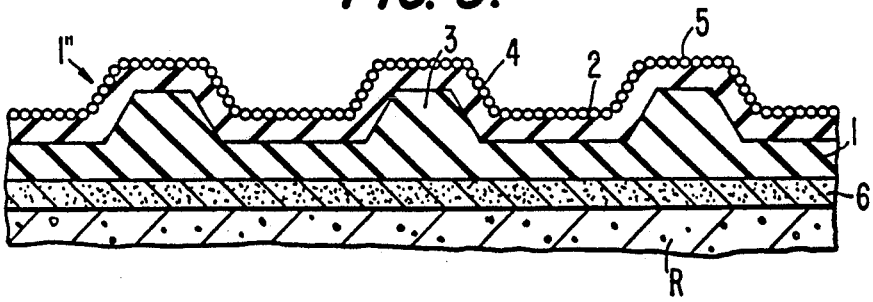
FIGS. 5 and 6 are cross-sectional similar to FIGS. 2 and 4 after the protuberances have been formed and showing retro-reflection glass microsphere distribution on the surfaces.
Figure 6:
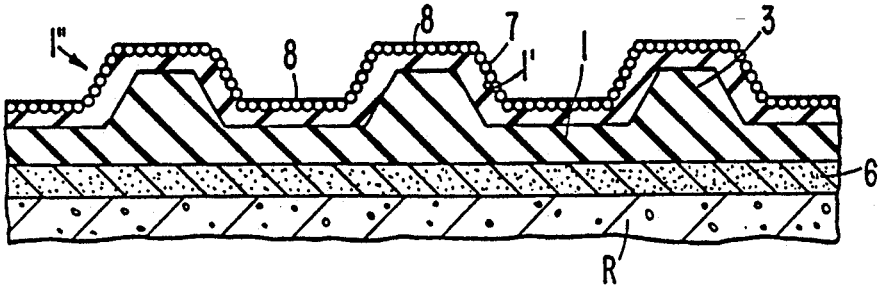

As shown in the cross-section of FIG. 6, the glass microspheres 7 are embedded in the cross-linked top portion of the rubber sheeting of FIG. 2. This can be accomplished prior to embossing or during the embossing process itself. The glass microspheres 7 are only partially embedded on the near-vertical or inclined faces of the ridges 3, whereas those shown typically at 8 are fully embedded during the embossment. In order to promote adhesion of these microspheres to the product, it has been found that silane is helpful either incorporated with the base material or as a coating on the microspheres or both. The adhesive layer 6, shown in FIGS. 5 and 6, bonds the marker to the road surface R and should exert as little influence as possible on the conformability characteristics of the product to insure good adhesion to the road surface.

The marker strips or tapes of the invention may be formed by the following illustrative methods of construction which provide the ability to maintain the ridged shape and still permit road surface conformability to assist in good adhesion thereto.

EXAMPLE 1

The ingredients listed in Table 1 below, were compounded using a lab roll mill and calender to form a sheet approximately 0.050 inch thick by 4 inches wide by several feet long. A squeegee was then used to apply a liquid layer of methanol and t-butyl perbenzoate onto the surface of the sheeting where a limited penetration of the surface with resulting peroxide occured. After drying with warm air for 30 seconds, the sheeting was then passed between a nip roller and a patterned embossing drum to impress a ridged pattern 3 into the top surface of the sheeting. The embossed material was then heated at 350° F. for 3 minutes during which time the upper layer 1' (FIG. 2) of the rubber sheeting impregnated with the peroxide became cross-linked. The surface durometer was measured at 65–70, whereas before treatment with the peroxide it was only 40.

The embossed strip containing the ridged pattern was then positioned beneath a flat sheet of metal and the wheel of a 1½ ton pick-up truck which was allowed to stand over this strip for 10 minutes, depressing the ridges. Inspection of the sample showed that the ridges had flattened to approximately 10% of their normal height. After a 10-minute waiting period, it was observed that the strip showed full recovery of the ridges and restoration to original shape. A similar test but without application of the peroxide failed to recover at all when subjected to the wheel loading for as short a time as 15 seconds.

Similar shape recovery or restoration from depression has been observed with actual vehicular travel as well.

TABLE I

| Material | Parts by Weight |
|---|---|
| Acrylonitrile butadiene non-crosslinked elastomer ("Hycar 1022" supplied by B.F. Goodrich) | 100 |
| Chlorinated paraffin ("Chlorowax 70-S" supplied by Diamond Shamrock) | 70 |
| Chlorinated paraffin ("Chlorowax 40") | 5 |
| Reinforcing wood-pulp-like cellulose fibers[1] | 120 |
| Pigment[2] | 130 |
| Glass microspheres (0.003 inch average diameter with a refractive index of 1.5) | 200 |
| Silica filler ("Hysil 233" supplied by PPG Industries) | 20 |

[1]("Interfibe" supplied by Sullivan Chemical)
[2]Titanium dioxide ("Tronox CR800" supplied by Kerr-McGee Chemical)

TABLE II

| Material | Parts by Weight |
|---|---|
| Precipitated sulfur | 3 |

EXAMPLE 2

Figure 3:
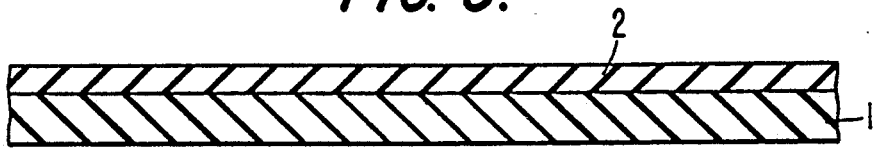
FIG. 3 is a cross-sectional through a double ply rubber sheeting prior to embossing the protuberances or ridges.
Figure 4:
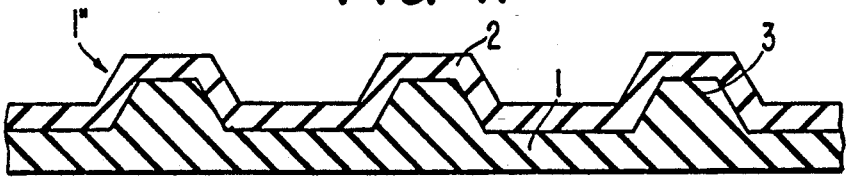
FIG. 4 is a cross-section through a double ply rubber sheeting after embossing the protuberances or ridges.

The ingredients in TABLE 1 were compounded into sheet form as in EXAMPLE 1 to form two separate sheets 1 and 2 (FIG. 3). The sheet 1 was calendered to a thickness of 0.040 inch. The layer 2, after the addition of precipitated sulfur in the amount of 3% total weight of rubber, was calendered to produce a 0.020 inch thick sheet. The sheets 1 and 2 were then laminated together and impressed with a ridged pattern 3 and heated at 350° F. for 9 minutes during which time the sulfur reacted with the rubber to effect vulcanization of the upper embossed layer 2 (FIG. 4). As in EXAMPLE 1, the strip was subjected to the truck tire weight for 10 minutes and reacted in a similar manner to the previous test, recovering fully after a 10 minute waiting period.

EXAMPLE 3

The procedure of EXAMPLE 2 was repeated except that a layer of isocyanate polyol liquid polyurethane such as sold under the trademark "Amershield" of Ameron Company, was applied on top of the sulfur-containing layer and a layer of glass microspheres 5 (FIG. 5) was applied to the liquid polyurethane layer 4 prior to embossing the ridged pattern. After the polyurethane was dry to the touch, the material was embossed and then subjected to 350° F. heat for 9 minutes. The truck tire test results were similar to those of EXAMPLE 1 and the glass microspheres were noted to be unchanged and firmly anchored.

EXAMPLE 4

The procedure of EXAMPLE 2 was repeated except that, prior to embossing, the sulfur-containing top surface 2 was given an overcoat of 20% solution of Dow Corning Z6040 "Silane" in methanol, followed by application of glass microspheres. The treated sheet was then subjected to 350° F. for 30 seconds and then embossed with a ridged pattern. The embossing procedure caused the beads 7 to be partially embedded on the near vertical faces and almost entirely embedded on the horizontal surfaces (FIG. 6). After embossing, the sheet was heated at 350° F. for 9 minutes to complete the vulcanization of the sulfur containing layer. The truck tire test results were similar to those of EXAMPLE 1 and the glass microspheres were observed to be unchanged and securely anchored to the vulcanized rubber.

Further modifications will also occur to those skilled in this art and such are considered to fall within the spirit and scope of the invention as defined in the appended claims.

What is claimed is:

1. A roadway marker strip for adhesive attachment along a bottom surface of the strip to a roadway, comprising a rubber-like sheet having a bottom layer and flat surface which posses cold-flow substantially memory-free characteristics and an upper layer and surface from which incident light from a vehicle traveling along the roadway may be reflected to indicate a roadway direction, said upper layer and surface of the sheet only being cross-link-vulcanized so as to possess substantial memory enabling restoration of depression of the upper surface caused by a vehicle, while the sheet bottom layer remains unvulcanized and conformably adheres to the roadway.

2. A roadway marker strip as claimed in claim 1, and in which the said upper layer and surface is modified by successively positioned partially embedded retroreflective bead protuberances therein.

3. A roadway marker strip as claimed in claim 1, and in which the said upper layer and surface contains successively positioned retroreflective beads therein.

* * * * *